US006348860B1

(12) United States Patent
Davis et al.

(10) Patent No.: US 6,348,860 B1
(45) **Date of Patent: *Feb. 19, 2002**

(54) EMERGENCY EVACUATION REPORTING SYSTEM AND METHOD FOR REPORTING AN EVACUATION STATUS FROM AN AFFECTED AREA TO A COMMAND CENTER

(75) Inventors: Timothy D. Davis, Temple; Terry L. Schock, Boyertwon, both of PA (US)

(73) Assignee: Lucent Technologies Inc., Murray Hill, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/304,381

(22) Filed: May 4, 1999

(51) Int. Cl.[7] ..... G08B 25/00

(52) U.S. Cl. ..... 340/525; 340/825.36; 340/825.49; 340/539; 340/332

(58) Field of Search ..... 340/332, 539, 340/531, 287, 331, 286.05, 286.06, 525, 825.28, 577, 628, 825.36, 825.49

(56) References Cited

U.S. PATENT DOCUMENTS 5,475,364 A * 12/1995 Kenet ..... 340/522
5,633,621 A * 5/1997 McDonald ..... 340/286.01

* cited by examiner

*Primary Examiner*—Daryl Pope
(74) *Attorney, Agent, or Firm*—Brown Raysman Millstein Felder & Steiner LLP

(57) ABSTRACT

In an emergency evacuation reporting system and method, a number of normally open illuminated push button switches are distributed throughout a facility at all normal and alternate exit routes for each area. The push button switches are connected to a command center for the facility. When an emergency area is evacuated, the LEDs representing the affected areas in the facility are energized red on a status panel in the command center. As the evacuation wardens verify each area clear of personnel, they press the most convenient push button switch for their area. This changes the red LED at the status panel to green and also illuminates the push button switch in the affected area.

14 Claims, 4 Drawing Sheets

FIG. 2B

LEGEND DISPLAY
208

| AREA | LOCATION |
|---|---|
| 1 | BUILDING 1, LOWER LEVEL, SOUTHWEST |
| 2 | BUILDING 1, LOWER LEVEL, NORTHWEST |
| 3 | BUILDING 1, LOWER LEVEL, SOUTHEAST |
| 4 | BUILDING 1, FIRST FLOOR, SOUTHWEST |
| 5 | BUILDING 1, FIRST FLOOR, SOUTHEAST |
| 6 | BUILDING 1, FIRST FLOOR, NORTH |
| 7 | BUILDING 1, SECOND FLOOR, EXECUTIVE |
| 8 | BUILDING 1, SECOND FLOOR, PURCHASING |
| 9 | BUILDING 1, SECOND FLOOR, MAIL ROOM/LOADING DOCK |
| 10 | BUILDING 1, THIRD FLOOR, CONFERENCE ROOMS |
| 11 | BUILDING 1, THIRD FLOOR, CAFETERIA/KITCHEN |
| 12 | BUILDING 2, LOWER LEVEL, SPINE EAST |
| 13 | BUILDING 2, LOWER LEVEL, SPINE WEST |
| 14 | BUILDING 3, FIRST FLOOR, POD 1, EAST |
| 15 | BUILDING 3, FIRST FLOOR, POD 1, WEST |
| 16 | BUILDING 3, FIRST FLOOR, POD 2, EAST |
| 17 | BUILDING 3, FIRST FLOOR, POD 2, WEST |
| 18 | BUILDING 3, FIRST FLOOR, POD 3, EAST |
| 19 | BUILDING 3, FIRST FLOOR, POD 3, WEST |
| 20 | BUILDING 3, FIRST FLOOR, POD 4, EAST |
| 21 | BUILDING 3, FIRST FLOOR, POD 4, WEST |
| 22 | BUILDING 2/3, FIRST FLOOR, CENTER SPINE EAST |
| 23 | BUILDING 2/3, FIRST FLOOR, CENTER SPINE EAST |
| 24 | BUILDING 2/3, FIRST FLOOR, CENTER SPINE WEST |
| 25 | BUILDING 2/3, FIRST FLOOR, CENTER SPINE WEST |
| 26 | BUILDING 2, SECOND FLOOR, CENTER SPINE EAST |
| 27 | BUILDING 2, SECOND FLOOR, CENTER SPINE WEST |
| 28 | BUILDING 2, SECOND FLOOR, POD 5, EAST |
| 29 | BUILDING 2, SECOND FLOOR, POD 5, WEST |
| 30 | BUILDING 2, SECOND FLOOR, POD 6, EAST |
| 31 | BUILDING 2, SECOND FLOOR, POD 6, WEST |
| 32 | BUILDING 2, SECOND FLOOR, POD 7 |
| 33 | BUILDING 2, SECOND FLOOR, POD 8, EAST |
| 34 | BUILDING 2, SECOND FLOOR, POD 8, WEST |
| 35 | BUILDING 2, SECOND FLOOR, POD 9, EAST |
| 36 | BUILDING 2, SECOND FLOOR, POD 9, WEST |
| 37 | BUILDING 2, SECOND FLOOR, POD 10, EAST |
| 38 | BUILDING 2, SECOND FLOOR, POD 10, WEST |

EMERGENCY EVACUATION REPORTING SYSTEM AND METHOD FOR REPORTING AN EVACUATION STATUS FROM AN AFFECTED AREA TO A COMMAND CENTER

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

The present invention disclosed herein relates generally to an emergency evacuation system. More particularly, the present invention relates to an emergency evacuation reporting system and method for automatically reporting an evacuation status from an affected area to a command center.

Despite great strides in science and technology in the last half of this century, handling of an emergency situation in a building occupied by many people remain at practically the same rudimentary level as before. Moreover, an increase of multi-storied buildings in the cities around the world has exacerbated the problem—due to their size, the high-rise buildings may create logistics nightmares during the evacuation proceedings.

When a fire alert or a bomb threat is announced via a PA system, an alarm, etc., building occupants of each floor proceed to the nearest exit, hopefully, in an orderly fashion, as previously rehearsed during emergency or fire drills. In a business setting, for example, people occupying the building select evacuation wardens to be assigned to each floor to conduct the evacuation proceedings. When the last person leaves the floor, a respective evacuation warden calls the command center to report on the status of the evacuation. The evacuation warden may report the area clear or request additional help, if needed, using a fire telephone system assigned for such use only.

There are several disadvantages associated with the above evacuation reporting procedure. The fire telephone system becomes overloaded as many evacuation wardens may attempt to reach the command center at the same time. Hence, some status evacuation reports may be missed or garbled. In addition, the evacuation warden has to wait for an operator to answer the telephone. Then, the evacuation warden has to report the situation to the operator and to confirm that the report is properly acknowledged at the command center. This procedure may take excessive time in requesting assistance of an emergency response team for example, and may jeopardize the lives of building occupants and evacuation warden.

A need therefore exists for an emergency evacuation reporting system and method that overcome the above, as well as other, disadvantages of the conventional evacuation procedure.

BRIEF SUMMARY OF THE INVENTION

It is an object of the present invention to provide an emergency evacuation reporting system and method.

It is another object of the present invention to provide the emergency evacuation reporting system and method for automatically reporting an evacuation status of the affected area to a command center.

It is still another object of the present invention to provide the emergency evacuation reporting system and method for automatically requesting the assistance in an emergency situation.

It is yet another object of the present invention to provide the emergency evacuation reporting system and method for automatically acknowledging receipt of the evacuation status of the affected area by the command center.

The above and other objects are achieved by an emergency evacuation reporting system for handling an evacuation of people from an affected area in a facility. The inventive system includes an emergency switch for generating a signal to indicate that people have been evacuated from the affected area. According to the inventive system, the emergency switch is located in the affected area. Further included in the inventive system is an indicator remotely located from the emergency switch for visually confirming the evacuation of people from the affected area in response to the generated signal.

In accordance with one aspect of the present invention, the indicator visually indicates an emergency situation in response to the generated signal.

In accordance with another aspect of the present invention, the emergency switch includes a light that is activated only if the remotely located indicator visually indicates the emergency situation in the affected area.

BRIEF DESCRIPTION OF THE DRAWINGS

The present invention is illustrated in the figures of the accompanying drawings which are meant to be exemplary and not limiting, in which like reference characters are intended to refer to like or corresponding parts, and in which:

FIG. 2B is a block diagram of a legend display of the command center for specifying the exact physical locations of illuminated emergency switches in a facility.

DETAILED DESCRIPTION OF THE PREFERRED EMBODIMENTS

As a general overview, the present invention allows an evacuation warden to provide a status report to a command center quickly and without the error-prone oral communication between the evacuation warden and an operator at the command center. According to the present invention, each floor exit in a building is provided with an emergency switch connected to a status display in the command center. Following the successful evacuation of people from the floor, the evacuation warden activates a respective emergency switch. The activation of the emergency switch causes a signal to be transmitted to the command center. The signal is received and processed at the command center, such that the status display visually indicates the evacuation status for each floor (level) based on the received signal.

Figure 1:
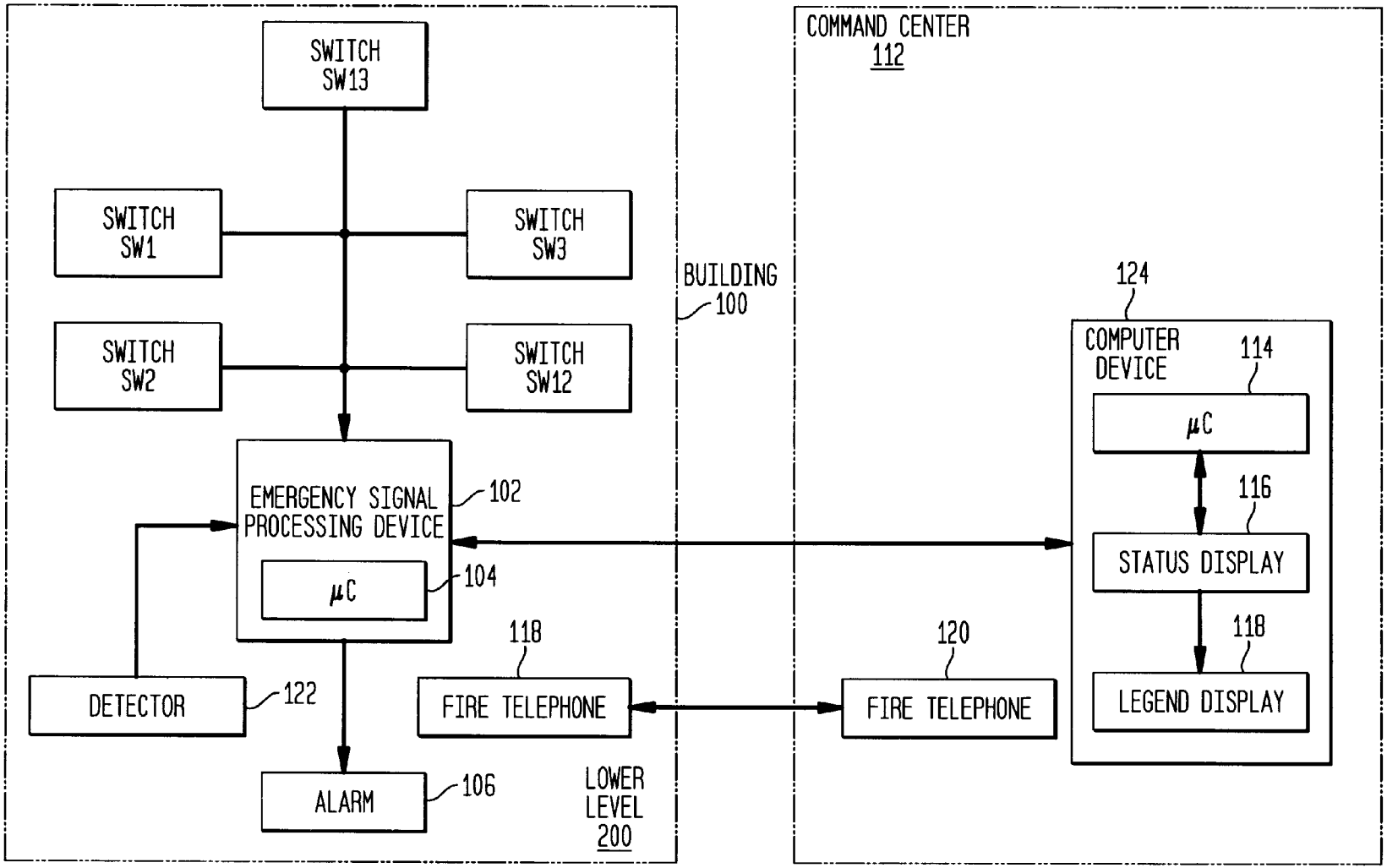
FIG. 1 is a block diagram of an emergency evacuation reporting system according to the present invention.

One embodiment of the present invention will now be described in detail with reference to the accompanying figures. In particular, FIG. 1 shows a block diagram of an emergency evacuation reporting system of the present invention. A representative lower level 200 in a building 100 contains an emergency signal processing device 102 having a programmable controller 104 for receiving, processing and transmitting various signals associated with a fire, a bomb threat, or some other emergency situation requiring, for example, the evacuation of people from the building 100. Further located in the building 100 is a number of illuminated emergency switches, each represented for example by a push-button switch with the light inside. As known to those skilled in the art, an illuminated emergency switch is normally open causing the light to be off, but when the illuminated emergency switch is activated, the light inside the emergency switch is turned on.

FIG. 1 representatively shows five illuminated emergency switches SW1, SW2, SW3, SW12, SW13 located in the building 100. The illuminated emergency switches SW1, SW2, SW3, SW12, SW13 are located near or in the vicinity of the building exits (not shown in the figure) on the lower level 200. Namely, each exit from the building 100 has at least one illuminated emergency switch nearby. The illuminated emergency switches SW1, SW2, SW3, SW12, SW13 are communicatively coupled, via a wired or wireless medium, to the emergency signal processing device 102.

Further shown in FIG. 1 is a detector 122 for detecting a distressful environmental condition posing a possible danger to the building occupants. The detector 122 may detect excessive smoke, high temperature, high level of carbon monoxide, etc.

FIG. 1 shows an alarm 106 for emitting a siren or any other sound in case of an emergency. The emergency signal processing device 102 controls the alarm 106 in response to the detector 122. Namely, the detector 122 detects, for example, a heavy smoke and transmits a signal to the emergency signal processing device 102. After receiving and processing the transmitted signal, the emergency signal processing device 102 sends a signal to the alarm 106 to activate the siren in the building 100.

The building 100 also contains a fire telephone 118 for transmitting and receiving voice signals similar to a conventional telephone. However, unlike the conventional telephone the fire telephone 118 is hard-wired to automatically dial a fire telephone 120 located in a command center 112 as soon as the handset of the fire telephone 188, for example, is lifted. The command center 112, remotely located from the lower level 200 and possibly from the building 100, is staffed with operators for responding to the emergency situations. The voice communication between the command center 112 and the building 100 is maintained via the fire telephones 118 and 120 as mentioned above.

Further according to FIG. 1, the emergency signal processing device 102 is communicatively coupled to a computer device 124 located in the command center 112. The computer device 124 includes a programmable controller 114 for processing signals received from the emergency signal processing device 102 and further includes a status display 116 for indicating the status of the illuminated emergency switches SW1, SW2, SW3, SW12, SW13 and other illuminated emergency switches (not shown) located throughout the building 100.

Figure 2A:
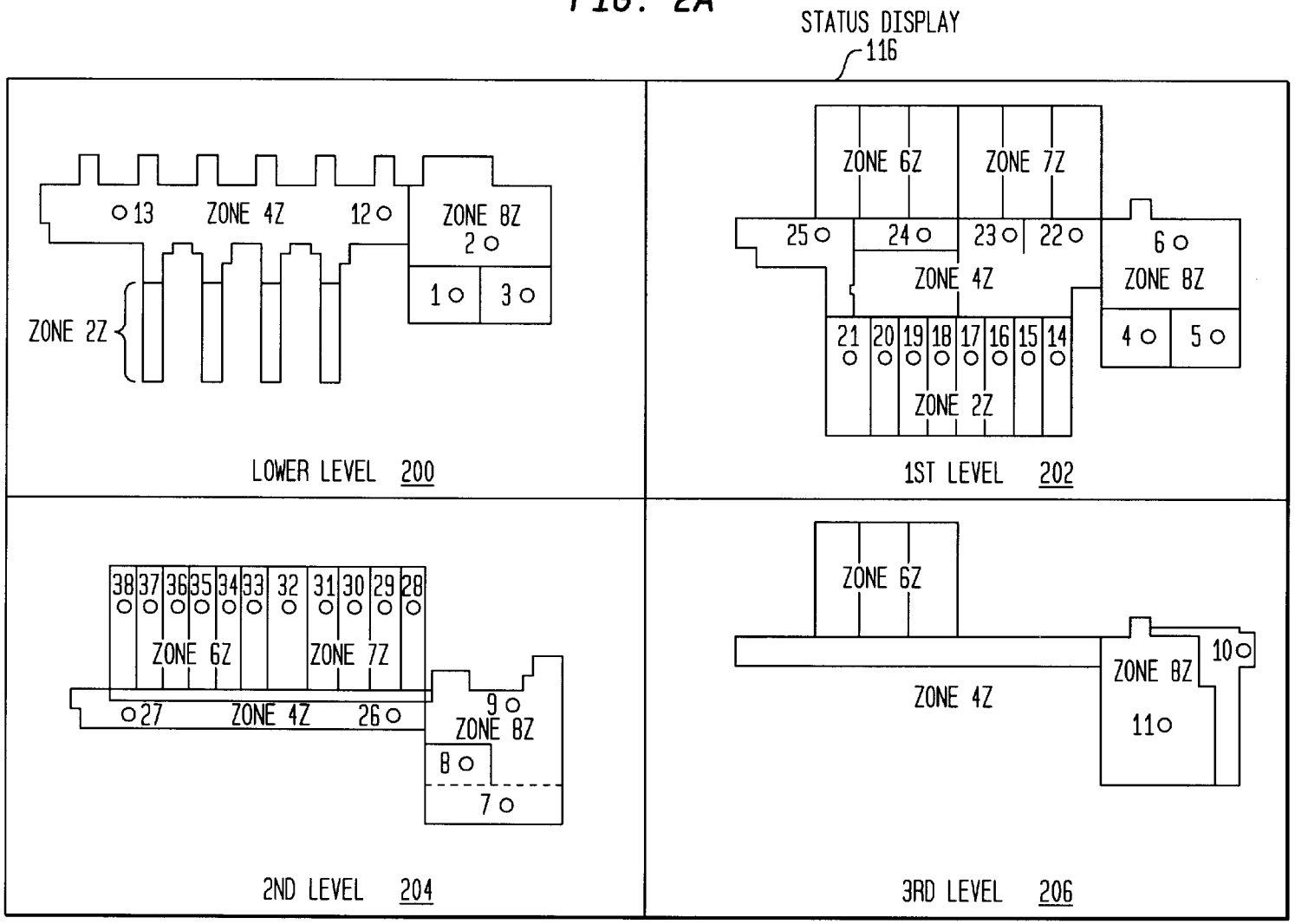
FIG. 2A is a block diagram of a status display located in the command center.

FIG. 2A shows the status display 116 in detail. It is noted that the status display 116 may be any display device, such as a computer monitor, LCD monitor, etc. In a preferred embodiment, the status display 116 is implemented with light-emitting diodes (LED) for indicating respective illuminated emergency switches in the building 100. As shown in FIG. 2A, the status display 116 shows a configuration of four levels: the lower level 200, the first level 202, the second level 204, and the third level 206 in the building 100. It is noted that FIG. 1 shows the block diagram of only one representative level of the building 100, that is the lower level 200, in order to avoid repeating the above description. Each level on the status display 116 represents the actual level or floor configuration in the building 100.

The lower level 200 is divided into three zones and has five emergency switches installed thereon, preferable near or in the vicinity of fire exits: three emergency switches are in a zone 8Z, two emergency switches are in a zone 4Z and no emergency switches are in a zone 2Z. The five emergency switches SW1, SW2, SW3, SW12, SW13 correspond to indicators 1, 2, 3, 12, 13 on the status display 116, as shown in FIG. 2A. As mentioned above, each indicator on the status display 116 is an LED according to the preferred embodiment of the present invention.

The first level 202 in the building 100 is divided into zones 2Z, 4Z, 6Z, 7Z, 8Z and contains fifteen emergency switches (not shown) corresponding to indicators 4–6, 14–25 on the status display 116 as illustrated in FIG. 2A. Similarly, there are four zones 4Z, 6Z, 7Z, 8Z in the second level 204 that has sixteen emergency switches (not shown) corresponding to indicators 7–9 26–38. The third level 206 is divided into three zones 4Z, 6Z, 8Z and has two emergency switches (not shown) corresponding to indicators 10, 11. In aggregate, there are 38 indicators on the status display 116 in a one-to-one correspondence with the illuminated emergency switches arranged throughout the four floors 200, 202, 204, 206 in the building 100.

FIG. 2B shows a block diagram of a legend display 208 for specifying the exact physical locations of the illuminated emergency switches SW1–SW38 in the building 100. In the preferred embodiment of the present invention, the legend display 208 is located adjacent the status display 116 in the command center 112. The legend display 208 shows the correspondence between the indicators 1–38 on the status display 116 and the actual locations of the emergency switches in the building 100, whereby practically each area of the building 100 can be quickly pinpointed by an emergency response team if necessary. It is emphasized that each indicator 1–38 corresponds to the respective illuminated emergency switch SW1–SW38 in the building 100. For example, the emergency switch SW1 corresponding to the indicator 1 is located in area 1, and according to the legend display 208, that area is in the southwest part of the lower level 200 as shown in FIG. 2B. Similarly, the emergency switch SW2 corresponding to the indicator 2 is located in area 2 which is in the northwest part of the lower level 200. Based on the legend display 208, an operator in the command center 112 can quickly determine the status of areas 1–38 that contain the emergency switches SW1–SW38, respectively, corresponding to the indicators 1–38.

The operation of the emergency evacuation reporting system of the present invention will now be explained with reference to the flowchart of FIG. 3 and the block diagram of FIG. 1. In step 300, an emergency situation is detected. For example, the detector 122 detects excessive smoke and notifies the emergency signal processing device 102 by sending a signal to be processed by the programmable controller 104. In step 302, the emergency signal processing device 102 activates the alarm 106 in response to the signal received from the detector 122. In step 304, the indicators are activated at the command center 112. In particular, substantially simultaneously with activating the alarm 106 in the building 100, the emergency signal processing device 102 sends a signal to the computer device 124 at the command center 112. The programmable controller 114 in the computer device 124 executes the instructions to send a signal to the status display 116. In response to the signal received from the programmable controller 114, the status display 116 turns on the indicators, selected from the indicators 1–38 at the status display 116, that represent areas affected by the smoke in the building 100. It is understood, of course, that all indicators 1–38 may be activated if the smoke has spread to all areas of the building 100 as detected by the detector 122.

In the preferred embodiment of the present invention, the selected LEDs are energized on the status display 116. In step 306, the programmable controller 114 executes the required instructions to determine whether any indicators have been deactivated at the command center 112. In particular, after evacuating the affected area of the building 100, the evacuation warden verifies the area clear of people—the situation is under control—and then activates any of the illuminated emergency switches located at normal and alternate exit routes in that area. In the preferred embodiment, the evacuation warden presses a push-button switch which is normally open. When the push-button switch is pressed, the contacts are closed, and the light inside the emergency switch is turned on. This gives an indication to the evacuation warden that the signal has been received at the command center 112. Once the evacuation warden presses the illuminated emergency switch, other illuminated emergency switches in the same area are also activated with their corresponding indicators being turned on at the status display 116.

At the command center 112, when the respective illuminated emergency switch is pressed, the corresponding indicator is deactivated at the status display 16. For example, the corresponding indicator may change its color from red to green at the status display 116. Hence, the operator at the command center 112 receives a visual indication that a particular area has been evacuated. Similarly, other indicators at the status display 16 are deactivated for the same area.

Figure 3:
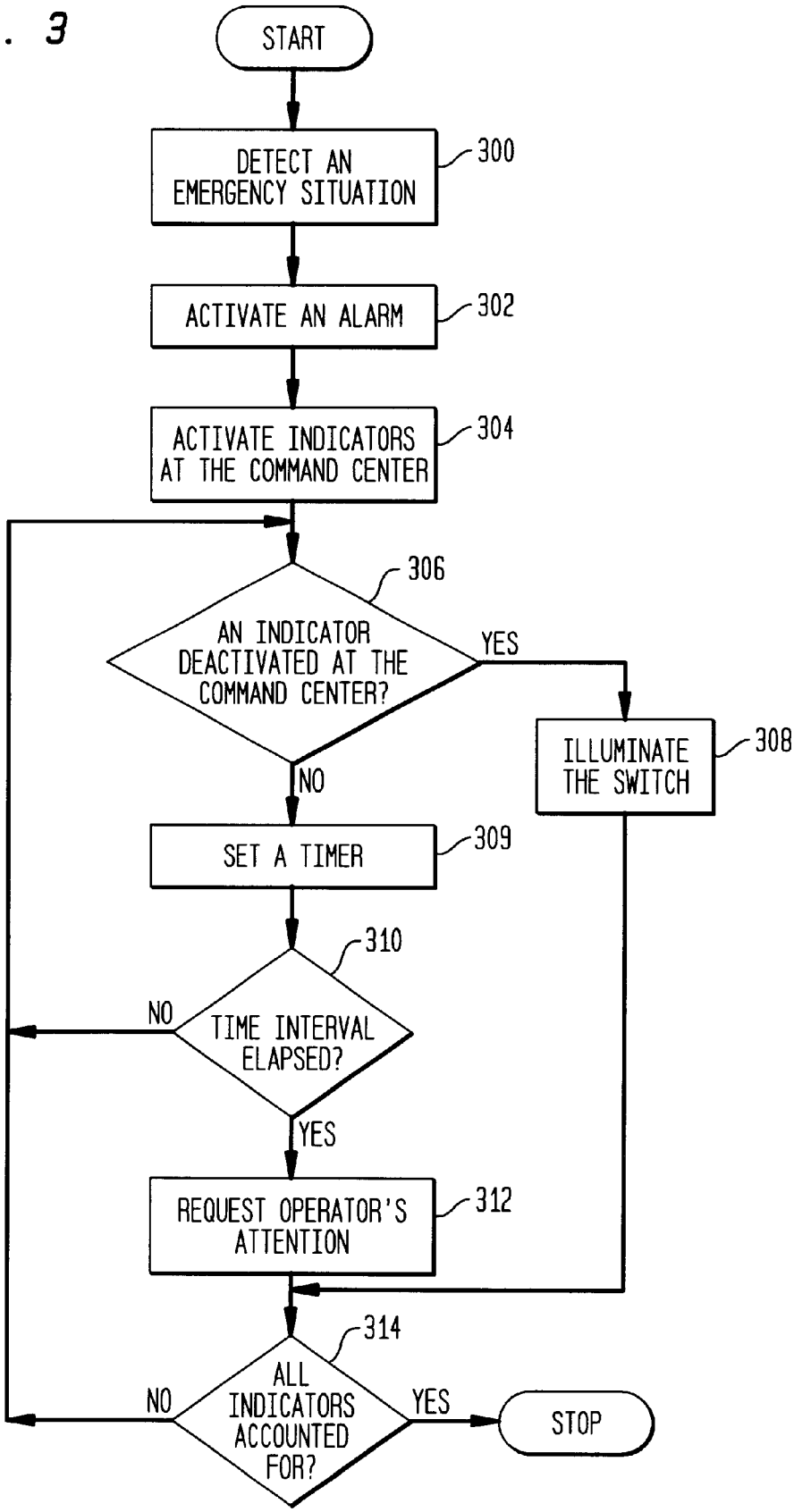
FIG. 3 is a flowchart describing the operation of the emergency evacuation reporting system.

As shown in FIG. 3, if an indicator at the status display 116 is deactivated in step 306 in response to the evacuation warden pressing the illuminated emergency switch, the programmable controller 114 sends a signal to the emergency signal processing device 122. In response to the received signal, the programmable controller 104 in the emergency signal processing device 122 is operative to turn on the light in the pressed illuminated emergency switch in the building 100 (step 308). Alternatively, the illuminated emergency switch may be hardwired in such a way that when the evacuation warden activates the illuminated emergency switch, the signal is sent from the activated illuminated emergency switch to the computer device 124, and that same signal is operative to turn on the light in the activated illuminated emergency switch. In this alternative embodiment, no response signal is required from the programmable controller 114 of the command center 112 to turn on the light in the activated illuminated emergency switch.

If the indicator in the affected area is not deactivated in step 306—the indicator has not changed from red to green—the programmable controller 114 starts a timer which is preset for a predetermined time interval, such as 10 minutes for example (step 309). In step 310, the programmable controller 114 determines whether the time interval has expired. If so, an operator's attention is requested in step 312. Namely, the indicator at the status display 116 starts flashing by intermittently going off and on. Most likely in that case, the command center operator will dispatch an emergency response team to the area in question to investigate the situation.

In step 314, the programmable controller 114 executes instructions to determine whether all of the indicators in the affected areas has been accounted for. If so, the occupants of the building 100 have been evacuated, and the evacuation procedure is terminated. Otherwise, the operational steps in the flowchart of FIG. 3 are repeated, starting with the operation in step 306, until the command center operator visually processes all of the indicators at the status display 116.

It is noted that if the evacuation warden requires assistance, a fire telephone system is available to maintain voice contact with the command center operator. The fire telephone system includes the fire telephones 118 and 120 in the building 100 and the command center 112, respectively, as shown in FIG. 1 and discussed hereinabove.

While in the preferred embodiment of the present invention, the LEDs are changed from red to green, it is understood that any other color may be used to alert the command center operator of the emergency situation and of the successful area evacuation. Similarly, the flashing LEDs indicative of the seriousness of the situation may be replaced with another form of notification, for example.

There are several advantages of the present invention over the conventional fire notification systems. According to the present invention no response is required from the command center to acknowledge or receive the status reports on the evacuation. Namely, the evacuation warden does not have to wait for the command center operator to answer the telephone and to acknowledge the report. Furthermore, since the information is available at a glance for all areas of the facility according to the present invention, the possibility of misinterpreting the information is virtually eliminated. In addition, the present invention makes available the emergency phone system for emergency communications that require two-way communication.

While the invention has been described and illustrated in connection with preferred embodiments, many variations and modifications as will be evident to those skilled in this art may be made without departing from the spirit and scope of the invention, and the invention is thus not to be limited to the precise details of methodology or construction set forth above as such variations and modification are intended to be included within the scope of the invention.

What is claimed is:

1. An emergency evacuation reporting system for handling an evacuation of people from an affected area in a facility, comprising:

an emergency switch, manually operated by one-touch activation, for generating a signal indicating that people have been evacuated from said affected area, said emergency switch being located in said affected area; and an indicator remotely located from said emergency switch for visually confirming the evacuation of people from said affected area in response to the generated signal.

2. The emergency evacuation reporting system according to claim 1, wherein said indicator visually indicates an emergency situation in response to the generated signal.

3. The emergency evacuation reporting system according to claim 2, wherein said emergency switch is illuminated only if said indicator visually indicates said emergency situation.

4. The emergency evacuation reporting system according to claim 1, further comprising:

a detector for detecting an emergency situation in said affected area and for generating a first signal indicative of said emergency situation;

a first programmable controller for processing said first signal and for generating a second signal based on the generated first signal; and an alarm for alerting the people of said emergency situation in response to said second signal received from said first programmable controller.

5. The emergency evacuation reporting system according to claim 4, further comprising a second programmable controller for controlling said indicator, and wherein said first programmable controller sends a third signal to said second programmable controller for controlling said indicator to visually indicate a start of said emergency situation in said affected area.

6. The emergency evacuation reporting system according to claim 5, wherein said first programmable controller sends a fourth signal to said second programmable controller for controlling said indicator to visually indicate that said emergency situation is under control in said affected area.

7. The emergency evacuation reporting system according to claim 5, wherein said second programmable controller controls said indicator to visually indicate that said emergency situation in said affected area requires an immediate attention if a predetermined time interval has elapsed from said start of said emergency situation.

8. An emergency evacuation reporting method for reporting an evacuation status from an affected area to a command center using an emergency switch located in said affected area, said method comprising the steps of:

in said affected area, generating a signal, in response to a manual operation of said emergency switch using one-touch activation, indicating that people have been evacuated from said affected area; and activating an indicator at said command center for visually confirming the evacuation of people from said affected area in response to the generated signal.

9. The emergency evacuation reporting method according to claim 8, wherein said indicator visually indicates an emergency situation in response to said signal generated by an emergency switch.

10. The emergency evacuation reporting method according to claim 9, further comprising illuminating said emergency switch located in said affected area only if said indicator visually indicates said emergency situation at said command center.

11. The emergency evacuation reporting method according to claim 8, further comprising:

detecting an emergency situation in said affected area;

generating a first signal at said affected area, said first signal being indicative of said emergency situation;

alerting the people of said emergency situation in said affected area in response to the generated first signal.

12. The emergency evacuation reporting method according to claim 11, further comprising sending a second signal from said affected area to said command center, said second signal controlling said indicator to visually indicate a start of said emergency situation in said affected area.

13. The emergency evacuation reporting method according to claim 12, further comprising sending a third signal from said affected area to said command center, said third signal controlling said indicator to visually indicate that said emergency situation is under control in said affected area.

14. The emergency evacuation reporting method according to claim 12, further comprising controlling said indicator to visually indicate that said emergency situation in said affected area requires an immediate attention if a predetermined time interval has elapsed from said start of said emergency situation.

* * * * *